United States Patent [19]

Ishida et al.

[11] Patent Number: 4,977,133

[45] Date of Patent: Dec. 11, 1990

[54] HEAT SENSITIVE RECORDING MATERIAL

[75] Inventors: Kouichi Ishida, Amagasaki; Mikio Nakamura, Nishinomiya; Yukio Takayama, Toyonaka, all of Japan

[73] Assignee: Kanzaki Paper Manufacturing Co., Ltd., Tokyo, Japan

[21] Appl. No.: 302,637

[22] Filed: Jan. 27, 1989

[30] Foreign Application Priority Data

Jan. 30, 1988 [JP] Japan ..... 63-20217

[51] Int. Cl.[5] ..... B41M 5/18

[52] U.S. Cl. ..... 503/226; 427/152; 503/200; 503/207; 503/214

[58] Field of Search ..... 427/150–152; 503/200, 207, 214, 226

[56] References Cited

U.S. PATENT DOCUMENTS

| | | | |
|---|---|---|---|
| 4,415,627 | 11/1983 | Miyauchi | 428/332 |
| 4,583,103 | 4/1986 | Hayashi et al. | 428/447 |
| 4,594,269 | 6/1986 | Miyauchi | 427/150 |

FOREIGN PATENT DOCUMENTS

| | | | |
|---|---|---|---|
| 0261970 | 3/1988 | European Pat. Off. . | |
| 0146794 | 11/1981 | Japan | 503/200 |
| 0201692 | 12/1982 | Japan | 503/200 |
| 0025988 | 2/1983 | Japan | 503/200 |
| 0202886 | 9/1986 | Japan | 503/200 |

*Primary Examiner*—Pamela R. Schwartz

*Attorney, Agent, or Firm*—Armstrong, Nikaido, Marmelstein, Kubovcik & Murray

[57] ABSTRACT

In a heat sensitive recording material comprising a substrate and a heat sensitive recording layer thereon containing a colorless or light-colored basic dye and a color acceptor which is reactive with the dye to form a color when contacted therewith, the recording material characterized in that an emulsion containing complex particles of colloidal silica and at least one of acrylic polymer and styrene-acrylic polymer is added to a coating composition for the recording layer and/or a coating composition for a protective layer formed on the recording layer.

9 Claims, No Drawings

HEAT SENSITIVE RECORDING MATERIAL

The present invention relates to a heat sensitive recording material, and particularly to a heat sensitive recording material which is excellent in retainability of the record image.

Heat sensitive recording materials are well known which are adapted to produce record images by thermally contacting a colorless or light-colored basic dye with an organic or inorganic color acceptor for a color forming reaction. These heat sensitive recording materials are relatively inexpensive and give record images by use of a compact recording machine which is operable by relatively simple maintenance work. Thus, the heat sensitive recording material has a wide use such as in record media for a facsimile, calculator, etc.

For example, as one of the uses, the heat sensitive recording material is increasingly used as a label with the development of POS (point of sales) system at retail stores.

However, when POS system is introduced at a supermarket, etc., the label frequently contacts water, oils or wrapping films containing plasticizer. As a result, the heat sensitive label has a defect in that the record image (printed image) thereon becomes faded.

Therefore, the heat sensitive recording material is demanded to have resistances to water, oil, plasticizer, etc.

to improve retainability of the record images, it is proposed that an aqueous emulsion, having film-forming ability and resistance to chemicals, is coated on a heat sensitive recording layer (JP-A-54-128347) or that polyvinyl alcohol or like water soluble high polymer is coated on a heat sensitive recording layer (U.S. Pat. No. 4,370,370, JU-A-56-125354), but newly arised problems occur with the improvement or sufficient effects are not necessarily attained. The terms "JP-A-" or "JU-A" means an "unexamined published Japanese patent or utility model application". Namely, in case of coating an aqueous resin on a heat sensitive recording layer, the drying temperature must be low in order to avoid color forming in the recording layer by high temperature drying, which results in insufficient curing of the resin layer to cause sticking phenomenon that the thermal head sticks to the resin layer when recording.

An object of the invention is to provide a heat sensitive recording material which is excellent in retainability of the record image and free from sticking or adhesion of tailings to the thermal head.

The above and other objects of the invention will become apparent from the following description.

In a heat sensitive recording material comprising a substrate and a heat sensitive recording layer thereon containing a colorless or light-colored basic dye and a color acceptor which is reactive with the dye to form a color when contacted therewith, the present invention provides a recording material characterized in that an emulsion containing complex particles of colloidal silica and at least one of acrylic polymer and styrene-acrylic polymer is added to a coating composition for the recording layer and/or a coating composition for a protective layer formed on the recording layer.

The present inventors have investigated the recording layer and a protective layer formed on the recording layer and have found that the stability of the record images can be remarkably improved with maintaining excellent recording stability by use of a specific emulsion containing complex particles. The present invention has been accomplished by the above finding.

In the present invention, the emulsion contained in the recording layer and/or protective layer is one having dispersed therein a resin containing a complex of colloidal silica and acrylic polymer or styrene-acrylic polymer. The emulsion is not particularly limited in the preparation method, and for example, is prepared by introducing colloidal silica into the resin component in the preparation of acrylic polymer or styrene-acrylic polymer. The colloidal silica can be introduced, for example, by reacting with a vinylsilane compound or like silane coupling agent which is previously copolymerized with the acrylic monomer and/or styrene monomer. The colloidal silica may be added during the polymerization reaction or after completion of the polymerization reaction.

The proportion of colloidal silica is not particularly limited but usually 1 to 200 parts by weight, preferably 30 to 150 parts by weight of colloidal silica is used per 100 parts by weight of the monomers constituting the acrylic polymer or styrene-acrylic polymer. With less than one part by weight of colloidal silica, a firm complex film is not obtained and more than 200 parts by weight, a film is hardly formed.

Examples of acrylic monomers which constitute the acrylic polymer or styrene-acrylic polymer are acrylic acid, methyl acrylate, ethyl acrylate, butyl acrylate, isobutyl acrylate, tert-butyl acrylate, cyclohexyl acrylate, 2-ethylhexyl acrylate, hydroxyethyl acrylate, methacrylic acid, methyl methacrylate, ethyl methacrylate, butyl methacrylate, isobutyl methacrylate, tert-butyl methacrylate, cyclohexyl methacrylate, 2-ethylhexyl methacrylate and hydroxyethyl methacrylate. The above acrylic monomers can be used singly or a mixture of at least two of them.

As a basic dye contained in the heat sensitive recording layer in the present invention are used various known colorless or light-colored basic dyes. Examples thereof are:

Triarylmethane-based dyes, e.g., 3,3-bis(p-dimethylaminophenyl)-6dimethylaminophthalide, 3,3-bis(p-dimethylaminophenyl)phthalide, 3-(p-dimethylaminophenyl)-3-(1,2-dimethylinodole-3-yl)phthalide, 3-(p-dimethylaminophenyl)-3-(2-methylindole-3-yl)phthalide, 3,3-bis(1,2-dimethylinode-3-yl)-5-dimethylaminophthalide, 3,3-bis (1,2-dimethylindole-3-yl)-6-dimethylaminophthalide, 3,3-bis (9-ethylcarbazole-3-yl)-6-dimethylaminophthalide, 3,3-bis (2-phenylindole-3-yl)-6-dimethylaminophthalide, 3-p-dimethylaminophenyl-3-(1-methylpyrrole-3yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucocauramine, etc.

Thiazine-based dyes, e.g., benzoyl-leucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenylspirodinaphthopyran, 3-methyl-naphtho-(6'-methoxybenzo)-spiropyran, 3-propyl-spirodibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7methoxyfluoran, 3-diethylamino-7chlorofluoran, 3-diethylamino-6methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6methyl-7phenylaminofluoran, 3-(N-ehtyl-p-toluidino)-6methyl-7(p-toluidino(fluoran, 3-diethylamino-6-methyl-7-phenylaminofluoran, 3-dibutylamino-6methyl-7-phenylaminofluoran, 3-diethylamino-7(2-carbomethoxyphenylamino)fluoran, 3-(N-cyclohexyl-N-methylamino)-6-methyl-7-phenylaminofluoran, 3-pyrrolidino-6methyl-7phenylaminofluoran, 3-piperidino-6methyl-7-phenylaminofluoran, 3-diethylamino-6-methyl-7-xylidinofluoran, 3-diethylamino-7-(o-chlorophenylamino)fluoran, 3-dibutylamino-7(o-chlorophenyl-amino)fluoran, 3-pyrrolidino-6-methyl-7-p-butylphenyl-aminofluoran, 3-diethylamino-7-(o-fluorophenylamino)fluoran, 3-dibutylamino-7-(o-fluorophenylamino)fluoran, 3-N-methyl-N-n-amyl)amino-6-methyl-7phenylaminofoluoran, 3-(N-ethyl-N-n-amyl-)amino-6-methyl-7-phenylaminofluoran, 3-N-ethyl-N-isoamyl)amino-6-methyl-7-phenylaminofluoran, 3-(N-methyl-N-n-hexyl)amino-67-methyl-7-phenylaminofluoran, 3(N-ethyl-N-n-hexyl)amino-6-methyl-7-phenylaminofluoran, 3-N-ehtyl-N-$\beta$-ethylhexyl)amino-6methyl-7phenylaminofluoran, etc. These basic dyes can be used, as required, in a mixture of at least two of them.

As a color acceptor are used various known inorganic and organic acidic materials which form color in contact with the basic dyes. Examples of useful inorganic acidic materials are activated clay, attapulgite, colloidal silica and aluminum silicate. Examples of organic acidic materials include 4-tert-butylphenol, 4-hydroxydiphenoxide, $\alpha$-naphthol, $\beta$-naphthol, 4-hydroxyacetophenone, 4-tert-octylcatechol, 2,2'-dihydroxydiphenyl, 4,4'-isopropylidenebis(2-tert-butylphenol), 4,4'-secbutylidenediphenol, 4-phenylphenol, 4,4'-isopropylidenediphenol, 2,2'-methylenebis(4-chlorophenol), hydroquinone, 4,4'-cyclohexylidenediphenol, 2,2-bis(4-hydroxyphenyl)-4-methylpoentane, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and like phenolic compounds; benzoic acid, ptert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4hydroxybenzoic acid, 3-tert-butylsalicyclic acid, 3-benzylsalicylic acid, 3-($\alpha$-methylbenzyl)salicylic acid, 3-chloro-5-($\alpha$-methylbenzyl)salicylic acid, 3,5-di-tert-butylsalicylic acid, 3-phenyl-5-($\alpha$, $\alpha$-dimethylbenzyl)-salicylic acid, 3,5-di-$\alpha$-methylbenzylsalicylic acid and like aromatic carboxylic acids, 4,4'-dihydroxydiphenylsulfone, 4-hydroxy-4'-isopropyloxydiphenylsulfone, 4-hydroxy-4'-methyldiphenyl-sulfone, 3,4-dihydroxydiphenylsulfone,, 3,4-dihydroxy-4'-methyldiphenylsulfone and like 4-hydroxydiphenylsulfone derivatives, 4,4'-dihydroxydiphenylfulfide, bis(3-tert-butyl-4-hydroxy-6-methylphenyl)sulfide, bis(2-methyl-4-hydroxy-6-tert butylphenyl)sulfide and like sulfide derivatives; also, salts of such phenolic compounds or aromatic carboxylic acids with zinc, magnesium, aluminum, calcium, titanium, manganese, tin, nickel and like polyvalent metals; complex of antipyrine and zinc thiocyanate, etc.

With the heat sensitive recording materials of the invention, the proportions of basic dye and color acceptor are not particularly limited but can be determined suitably according to the kinds of basic dye and color acceptor. For example, usually 1 to 50 parts by weight, preferably 2 to 10 parts by weight, of the color acceptor is used per part by weight of the basic dye.

A coating composition for the recording layer containing the foregoing components is usually prepared in water serving as a dispersion medium. In case the above specific emulsion containing complex particles of colloidal silica and acrylic polymer or styrene-acrylic polymer is added to the coating composition, the emulsion is added in an amount of about 1 to 70% by weight (as solids), preferably about 4 to 30% by weight based on the solids of the coating composition.

In the present invention, a binder can be conjointly used in an amount which does not give an adverse effect. Examples of useful binders are starches, hydroxyethyl cellulose, methyl cellulose, carboxymethyl cellulose, gelatin, casein, gum arabic, polyvinyl alcohol, acetoacetylated polyvinyl alcohol, diisobutylene-maleic anhydride copolymer salt, styrene-maleic anhydride copolymer salt, ethylene-acrylic acid copolymer salt, styrene-acrylic acid copolymer salt, styrene-butadiene copolymer emulsion, urea resin, melamine resin, amide resin, etc. In case of using the above binder, the binder is conjointly used in an amount of usually up to 10 parts by weight (as solids), preferably up to 5 parts by weight per part by weight of the solids of the specific emulsion containing complex particles.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., ultraviolet absorbers such as benzophenone compounds, defoaming agents, fluorescent dyes, coloring dyes, etc.

Further, to the composition may be added zinc stearate, calcium stearate, polyethylene wax, carnauba wax, paraffin wax, ester wax or like waxes, kaolin, clay, talc, calcium carbonate, calcined clay, titanium dioxide, kieselguhr, finely divided anhydrous silica, activated clay or like inorganic pigment. A sensitizer may also be and color acceptor. For example, usually 1 to 50 parts used depending on the purpose. Examples of useful sensitizers are stearic acid amide, stearic acid methylenebisamide, oleic acid amide, palmitic acid amide, coconut fatty acid amide or like fatty acid amides, 2,2'-methylenebis(4-methyl-6-tert-butylphenol), 4,4'-butylidenebis(6-tert-butyl-3-methylphenol), 2,2'-methylenebis(4-ethyl-6-tert-butylphenol), 2,4-di-tert-butyl-3-methylphenol) or like hindered phenols, 2-(2'-hydroxy-5'-methylphenyl)benzotriazole, 2-hydroxy-4-benzyloxybenzophenone, 1,2-di(3-methylphenoxy)ethane, 1,2-diphenoxyethane, 1-phenoxy-2-(4-methylphenoxy)ethane, dimethyl terephthalate, dibutyl terephthalate, dibenzyl terephthalate, dibutyl isophthalate, phenyl 1-hydroxynaphthoate, and various known heat-fusible materials.

The amount of the sensitizer is not particularly limited and is preferably up to 4 parts by weight per one part by weight of the color acceptor.

The amount of the pigment is not also particularly limited and is usually up to 70% by weight based on the total solids of the coating composition.

In the present heat sensitive recording material, the method of forming the recording layer is not particularly limited. For example, the coating composition is applied to a substrate by an air knife coater, variable-bar blade coater, pure blade coater, short dwell coater or like suitable means and dried. The amount of coating composition to be applied, which is not limited particularly, is usually 2 to 12 g/m$^2$, preferably 3 to 10 g/m$^2$, based on dry weight.

In the present heat sensitive recording material, an extremely excellent effect can be attained in record image retainability and recording stability by incorporating the above specific emulsion containing complex particles in the recording layer and/or the protective layer formed on the recording layer. In case that the complex particle emulsion is contained in the protective layer, it may be possible to form a protective layer with conjoint use of water-soluble or water-dispersible high polymer which is used to form a usual protective layer.

As the water-soluble or water-dispersible high polymer used for forming the protective layer, are employed the above various binders. Among them, acetoacetylated polyvinyl alcohol is preferable since it exhibits an excellent effect in combination with the present specific substance.

In case of forming a protective layer by use of the specific emulsion containing complex particles and other binder, the binder is conjointly used in an amount of usually up to 10 parts by weight (as solids), preferably up to 5 parts by weight per part by weight of the solids of the specific emulsion containing complex particles.

In order to improve printability or sticking, a pigment is added as required to the protective layer. Examples of useful pigments are calcium carbonate, zinc oxide, aluminum oxide, titanium dioxide, silicon dioxide, aluminum hydroxide, barium sulfate, zinc sulfate, talc, kaolin, clay, calcined clay, colloidal silica or like inorganic pigment; styrene microball, nylon powder, polyethylene powder, urea-formalin resin filler, raw starch particle or like organic pigment. The amount of pigment is preferably about 5 to 500 parts by weight per 100 parts by weight of total of the binder and the specific emulsion.

Further, to the composition may be added zinc stearate, calcium stearate, polyethylene wax, carnauba wax, paraffin wax, ester wax or like waxes; sodium dioctylsulfosuccinate or like surfactants (dispersants or wetting agents); defoaming agents; and other various auxiliary agents. In order to improve water resistance, glyoxal, boric acid, dialdehyde starch, epoxy compound or like curing agent may be added.

A coating composition used for forming the protective layer is usually prepared in water serving as a dispersion medium. In case the above specific emulsion containing complex particles of colloidal silica and acrylic polymer or styrene-acrylic polymer is added to the coating composition, the emulsion is added in an amount of about 1 to 50% by weight (as solids), preferably about 4 to 30% by weight based on the solids of the coating composition.

The coating composition for the protective layer is applied by an appropriate coating apparatus to the heat sensitive recording layer. Since more than 20g/m$^2$ by dry weight in the amount of coating composition markedly lowers the recording sensitivity of the heat sensitive recording material, the amount is usually about 0.1 to 20g/m$^2$, preferably 0.5 to 10 g/m$^2$.

As required, it is possible to enhance the preservability by providing a protective layer on the rear surface of the heat sensitive recording material. Moreover, various known techniques in the field of heat sensitive recording material, such as provision of an undercoat layer to the substrate, can be employed. An adhesive layer can be provided on the rear surface of the substrate to obtain an adhesive label.

As the substrate is used paper, synthetic fiber paper, synthetic resin film or the like, but paper is most preferable in view of cost, coating suitability and the like.

It is not evident why the record image retainability is remarkably improved with maintaining an excellent recording suitability and without suffering from adverse effect on the thermal head, by incorporating into the recording layer and/or the protective layer the above specific emulsion containing complex particles of colloidal silica and acrylic polymer or styrene-acrylic polymer. However, according to the investigation by the present inventors, it is presumed that the coating film is effectively improved in hardness without rendering the film-forming temperature so high by introducing colloidal silica in the form of complex particles to acrylic polymer or styrene-acrylic polymer, and as a result, a coating film is obtained which is superior in resistances to water and heat, barrier property, film transparency to that from usual acrylic emulsion or styrene-acrylic emulsion, and the heat sensitive recording material is obtained which is stable when contacted with oil, fat, plasticizer, etc. and excellent in suitability to the thermal head.

The invention will be described below in more detail with reference to Examples by no means limited to, in which parts and percentages are all by weight, unless otherwise specified.

EXAMPLE 1

(1) Composition (A)

| | |
|---|---|
| 3-(N-Ethyl-N-isoamyl)amino-6-methyl-7-phenylaminofluoran | 10 parts |
| 5% Aqueous solution of methyl cellulose | 5 parts |
| Water | 40 parts |

These components were pulverized by a sand mill to prepare Composition (A) having an average particle size of 3 μm.

(2) Composition (B)

| | |
|---|---|
| 4,4'-Isopropylidenediphenol | 30 parts |
| 5% Aqueous solution of methyl cellulose | 5 parts |
| Water | 80 parts |

These components were pulverized by a sand mill to prepare Composition (B) having an average particle size of 3 μm.

(3) Composition (C)

| | |
|---|---|
| 1,2-Di(3-methylphenoxy)ethane | 20 parts |
| 5% Aqueous solution of methyl cellulose | 5 parts |
| Water | 55 parts |

These components were pulverized by a sand mill to prepare Composition (C) having an average particle size of 3 μm.

(4) Preparation of a recording layer

A coating composition was prepared by mixing with stirring 55 parts of Composition (A), 115 parts of Composition (B), 80 parts of Composition (C), 80 parts of an emulsion having 45% concentration and containing complex particles of colloidal silica and styrene-methyl acrylate copolymer (monomer components: colloidal silica = 100 : 70), and 35 parts of calcium carbonate. To a paper substrate weighing 50g/m$^2$ was applied and dried the above coating composition in an amount of 6g/m$^2$ by dry weight to obtain a heat sensitive recording paper.

EXAMPLE 2

A heat sensitive recording paper was prepared in the same manner as in Example 1 except that, in the preparation of the recording layer, an emulsion (45% concentration) containing complex particles of colloidal silica and styrene-2-ethylhexyl acrylate-methyl methacrylate copolymer (monomer components:colloidal silica=100:70) was used in place of the emulsion containing complex particles of colloidal silica and styrene-methyl acrylate copolymer.

EXAMPLE 3

A heat sensitive recording paper was prepared in the same manner as in Example 1 except that, in the preparation of the recording layer, an emulsion (45% concentration) containing complex particles of colloidal silica and methyl acrylate-methyl methacrylate copolymer (monomer components:colloidal silica=100:70) was used in place of the emulsion containing complex particles of colloidal silica and styrene-methyl acrylate copolymer.

COMPARISON EXAMPLE 1

A heat sensitive recording paper was prepared in the same manner as in Example 1 except that, in the preparation of the recording layer, 80 parts of an emulsion (45% concentration) of styrene-methyl acrylate copolymer was used in place of the emulsion containing complex particles of colloidal silica and styrene-methyl acrylate copolymer.

COMPARISON EXAMPLE 2

A heat sensitive recording paper was prepared in the same manner as in Example 1 except that, in the preparation of the recording layer, 80 parts of an aqueous solution (10% concentration) of polyvinyl alcohol was used in place of the emulsion containing complex particles of colloidal silica and styrene-methyl acrylate copolymer.

COMPARISON EXAMPLE 3

A heat sensitive recording paper was prepared in the same manner as in Example 1 except that, in the preparation of the recording layer, 50 parts of emulsion of styrene-methyl acrylate copolymer (45% concentration) and 50 parts of 30% aqueous dispersion of colloidal silica were used in place of 80 parts of the emulsion containing complex particles of colloidal silica and styrene-methyl acrylate copolymer.

Six kinds of the heat sensitive recording papers thus obtained were checked for the following evaluation tests. The results were shown in Table 1.

(Whiteness)

The whiteness of the recording layer was measured with use of a Hunter multipurpose reflectometer in order to check the degree of fogging.

(Color density)

The record images printed by use of a thermal printer (Texas Instruments Inc., Model PC-100A) were checked for color density by Macbeth densitometer (Model RD-100R, a product of Macbeth Corp.).

(Sticking)

Degree of sticking was observed when the record images were printed with use of a thermal printer.

(Water resistance)

To the recorded portion of the heat sensitive recording paper was added one drop of water and the portion was rubbed with a finger ten times after 30 seconds and the variation in the color density was checked with an unaided eye to evaluate water resistance.

(Evaluation criteria)

TABLE 1

| | Whiteness (%) | Color density | Sticking | Water resistance |
|---|---|---|---|---|
| Ex. 1 | 82.0 | 1.25 | ○ | ○ |
| 2 | 82.3 | 1.20 | ○ | ○ |
| 3 | 81.8 | 1.22 | ○ | ○ |
| Com. Ex. 1 | 81.4 | 1.20 | X | Δ |
| 2 | 81.1 | 1.10 | ○ | X |
| 3 | 81.0 | 1.09 | Δ | X |

○: excellent and practically no problem
Δ: slightly inferior and problem depending on use
x: extremely inferior and practically useless

EXAMPLE 4

A recording layer was prepared in the same manner as in Example 1 except that, in the preparation of the recording layer, 100 parts of an aqueous solution (10% concentration) of polyvinyl alcohol was used in place of the emulsion containing complex particles of colloidal silica and styrene-methyl acrylate copolymer.

To the obtained recording layer was applied and dried a coating composition composed of the following components in an amount of 5g/m$^2$ by dry weight to obtain a heat sensitive recording paper having a protective layer.

| | |
|---|---|
| (1) Coating composition for a protective layer | 50 parts |
| Emulsion having 45% concentration and containing complex particles of colloidal silica and styrene-methyl acrylate copolymer (monomer components:colloidal silica = 100:70) | |
| Calcium carbonate | 100 parts |
| Water | 200 parts |

EXAMPLE 5

A heat sensitive recording paper having a protective layer was prepared in the same manner as in Example 4 except that, in the coating composition for a protective layer, an emulsion (45% concentration) containing complex particles of colloidal silica and styrene-cyclohexyl acrylate-methyl methacrylate copolymer (monomer components:colloidal silica=100:70) was used in place of the emulsion containing complex particles of colloidal silica and styrene-methyl acrylate copolymer.

EXAMPLE 6

A heat sensitive recording paper having a protective layer was prepared in the same manner as in Example 4 except that the following coating composition was used for a protective layer.

| | |
|---|---|
| (1) Coating composition for a protective layer | 40 parts |
| Emulsion having 45% concentration and containing complex particles of colloidal silica and styrene-methyl acrylate copolymer (monomer components:colloidal silica = 100:70) | |
| 10% Aqueous solution of polyvinyl alcohol | 200 parts |

EXAMPLE 7

A heat sensitive recording paper having a protective layer was prepared in the same manner as in Example 6 except that the coating composition for the recording layer of Example 1 was used in place of that for the recording layer of Example 6.

COMPARISON EXAMPLE 4

A heat sensitive recording paper having a protective layer was prepared in the same manner as in Example 4 except that, in the coating composition for a protective layer, 50 parts of an emulsion (45% concentration) of styrene-methyl acrylate copolymer was used in place of the emulsion containing complex particles of colloidal silica and styrene-methyl acrylate copolymer.

COMPARISON EXAMPLE 5

A heat sensitive recording paper having a protective layer was prepared in the same manner as in Example 4 except that, in the coating composition for a protective layer, 200 parts of an aqueous solution (10% concentration) of polyvinyl alcohol was used in place of the emulsion containing complex particles of colloidal silica and styrene-methyl acrylate copolymer.

COMPARISON EXAMPLE 6

A heat sensitive recording paper having a protective layer was prepared in the same manner as in Example 4 except that the following coating composition was used for a protective layer.

| | |
|---|---|
| (1) Coating composition for a protective layer | 40 parts |
| Emulsion of styrene-methyl acrylate copolymer (45% concentration) | |
| 30% Aqueous dispersion of colloidal silica | 20 parts |
| Calcium carbonate | 100 parts |
| Water | 200 parts |

Seven kinds of the heat sensitive recording papers thus obtained were checked for resistances to plasticizer and oil by the following methods in addition to the aforementioned evaluation tests. The results are given in Table 2.

(Resistance to plasticizer)

A polyvinyl chloride wrap film (a product of Mitsui Toatsu Chemicals, Inc.) was wound threefold around a polypropylene pipe (40mmϕ). A heat sensitive recording paper having formed images was superposed on the film with image outward and thereon was wound a polyvinyl chloride wrap film threefold. The color density was measured after maintained at 40° C. for 24 hours to evaluate resistance to plasticizer.

Resistance to oil)

A few drops of cotton seed oil were applied to the images. The oil was wiped off with gauze after 24 hours and then the color density was measured to evaluate resistance to oil.

(Evaluation criteria)

TABLE 2

| | Example | | | | Comparison Example | | |
|---|---|---|---|---|---|---|---|
| | 4 | 5 | 6 | 7 | 4 | 5 | 6 |
| Whiteness (%) | 80.2 | 81.0 | 80.4 | 80.4 | 80.3 | 79.5 | 78.3 |
| Color density | 1.10 | 1.08 | 1.04 | 1.06 | 1.08 | 0.90 | 1.00 |
| Sticking | ○ | ○ | ○ | ○ | X | ○ | X |
| Water resistance | ◎ | ◎ | ○ | ◎ | Δ | X | Δ |
| Plasticizer resistance | ○ | ○ | ○ | ○ | X | Δ | Δ |
| Oil resistance | ○ | ○ | ○ | ○ | Δ | Δ | Δ |

◎ extremely excellent and practically no problem at all
○ excellent and practically no problem
Δ slightly inferior and problem depending on use
X extremely inferior and practically useless As apparent from Tables 1 and 2, the present heat sensitive recording material is excellent in the retainability of the images, free from troubles such as sticking, exhibits no fogging and don't decrease in color density, hence is excellent recording material.

We claim:

1. A heat sensitive recording material comprising a substrate, a heat sensitive recording layer thereon, containing a colorless or light-colored basic dye and a color acceptor which is reactive with the dye to form a color when contacted therewith, and a coating, containing a dried emulsion comprising complex particles of colloidal silica and at least one acrylic polymer disposed over said recording material.

2. A heat sensitive recording material as defined in claim 1, wherein the acrylic monomer which comprises the acrylic polymer is at least one of acrylic acid, methyl acrylate, ethyl acrylate, butyl acrylate, isobutyl acrylate, tert-butyl acrylate, cyclohexyl acrylate, 2-ethylhexyl acrylate, hydroxyethyl acrylate, methacrylic acid, methyl methacrylate, ethyl methacrylate, butyl methacrylate, isobutyl methacrylate, tert-butyl methacrylate, cyclohexyl methacrylate, 2-ethylhexyl methacrylate or hydroxyethyl methacrylate.

3. A heat sensitive recording material as defined in claim 1 wherein the colloidal silica is used in an amount of 1 to 200 parts by weight per 100 parts by weight of the monomers constituting the acrylic polymer of styrene-acrylic polymer.

4. A heat sensitive recording material as claimed in claim 1, wherein said acrylic polymer is a styrene-acrylic copolymer.

5. A heat sensitive recording material as claimed in claim 4 wherein the acrylic portion of said copolymer is at least one of acrylic acid, methyl acrylate, ethyl acrylate, butyl acrylate, isobutyl acrylate, tert-butyl acrylate, cyclohexyl acrylate, 2-ethylhexyl acrylate, hydroxyethyl acrylate, methacrylic acid, methyl methacrylate, ethyl methacrylate, butyl methacrylate, isobutyl methacrylate, tert-butyl methacrylate, cyclohexyl methacrylate, 2-ethylhexyl methacrylate or hydroxyethyl methacrylate.

6. A heat sensitive recording material as claimed in claim 1, wherein said emulsion is incorporated in a coating on said recording layer.

7. A heat sensitive recording material as defined in claim 6, wherein the emulsion is present in an amount of about 1 to 70% by weight (as solids) based on the solids of the coating composition on the recording layer.

8. A heat sensitive recording material as claimed in claim 1, wherein said emulsion is incorporate in a protective layer coated over said recording layer.

9. A heat sensitive recording material as defined in claim 8, wherein the emulsion is present in an amount of about 1 to 50% by weight (as solids) based on the solids of the coating composition on the protective layer.

* * * * *